US005447621A

United States Patent [19]

Hunter

[11] Patent Number: 5,447,621

[45] Date of Patent: Sep. 5, 1995

[54] INTEGRATED PROCESS FOR UPGRADING MIDDLE DISTILLATE PRODUCTION

[75] Inventor: Michael G. Hunter, Katy, Tex.

[73] Assignee: The M. W. Kellogg Company, Houston, Tex.

[21] Appl. No.: 187,923

[22] Filed: Jan. 27, 1994

[51] Int. Cl.[6] ..... C10G 69/02

[52] U.S. Cl. ..... 208/058; 208/060

[58] Field of Search ..... 208/58, 60; 422/188, 422/190

[56] References Cited

U.S. PATENT DOCUMENTS

| | | | |
|---|---|---|---|
| 2,853,439 | 9/1958 | Ernst, Jr. | 196/52 |
| 3,230,164 | 1/1966 | Williams III, et al. | 208/60 |
| 3,592,757 | 7/1971 | Baral | 208/58 |
| 3,655,551 | 4/1972 | Hass et al. | 208/58 |
| 3,671,419 | 6/1972 | Ireland et al. | 208/57 |
| 4,973,396 | 11/1990 | Markley | 208/89 |
| 4,990,242 | 2/1991 | Louie et al. | 208/218 |
| 5,026,472 | 6/1991 | Hoehn et al. | 208/58 |
| 5,114,562 | 5/1992 | Haun et al. | 208/89 |

FOREIGN PATENT DOCUMENTS

| | | | |
|---|---|---|---|
| 0189648 | 8/1986 | European Pat. Off. | 208/58 |

OTHER PUBLICATIONS

Hibbs et al., "Alternative Hydrocracking Applications," published by UOP of Des Plaines, IL (1990).

Donnelly et al., *Oil & Gas Journal*, Oct. 27, 1980, pp. 72–82.

Gembicki et al., *Oil & Gas Journal*, Feb. 21, 1983, pp. 116–128.

S. L. Lee et al., "Aromatics Reduction and Cetane Improvement of Diesel Fuels, " published by Akzo Chemicals NV. (No Date).

O. Biceroglu et al., "Aromatics Reduction and Centane Improvement of Diesel Fuels, " published by Akzo Chemicals NV. (No Date).

Manufacturer's sales brochure for MAK hydrocracking technology, chemical sales and processes, Mobil Corporation, Akzo Chemicals and the M. W. Kellogg Company. (No Date).

*Primary Examiner*—Asok Pal

*Assistant Examiner*—Walter D. Griffin

*Attorney, Agent, or Firm*—The M. W. Kellogg Company

[57] ABSTRACT

An integrated middle distillate upgrading process and unit are disclosed. A middle distillate side-stream of a conventional single stage hydrocracking process is circulated to a hydrotreating stage such as an aromatics saturation reactor and/or a catalytic dewaxing reactor to effect middle distillate upgrade. The upgraded product is then finished in a fractionation stage side-stripper column. The integrated hydrotreating reactor can share the duty of existing hydrocracker stage equipment and take advantage of existing process heat to eliminate the need for much of the equipment generally required by a stand-alone hydrotreating reactor of the prior art.

8 Claims, 1 Drawing Sheet

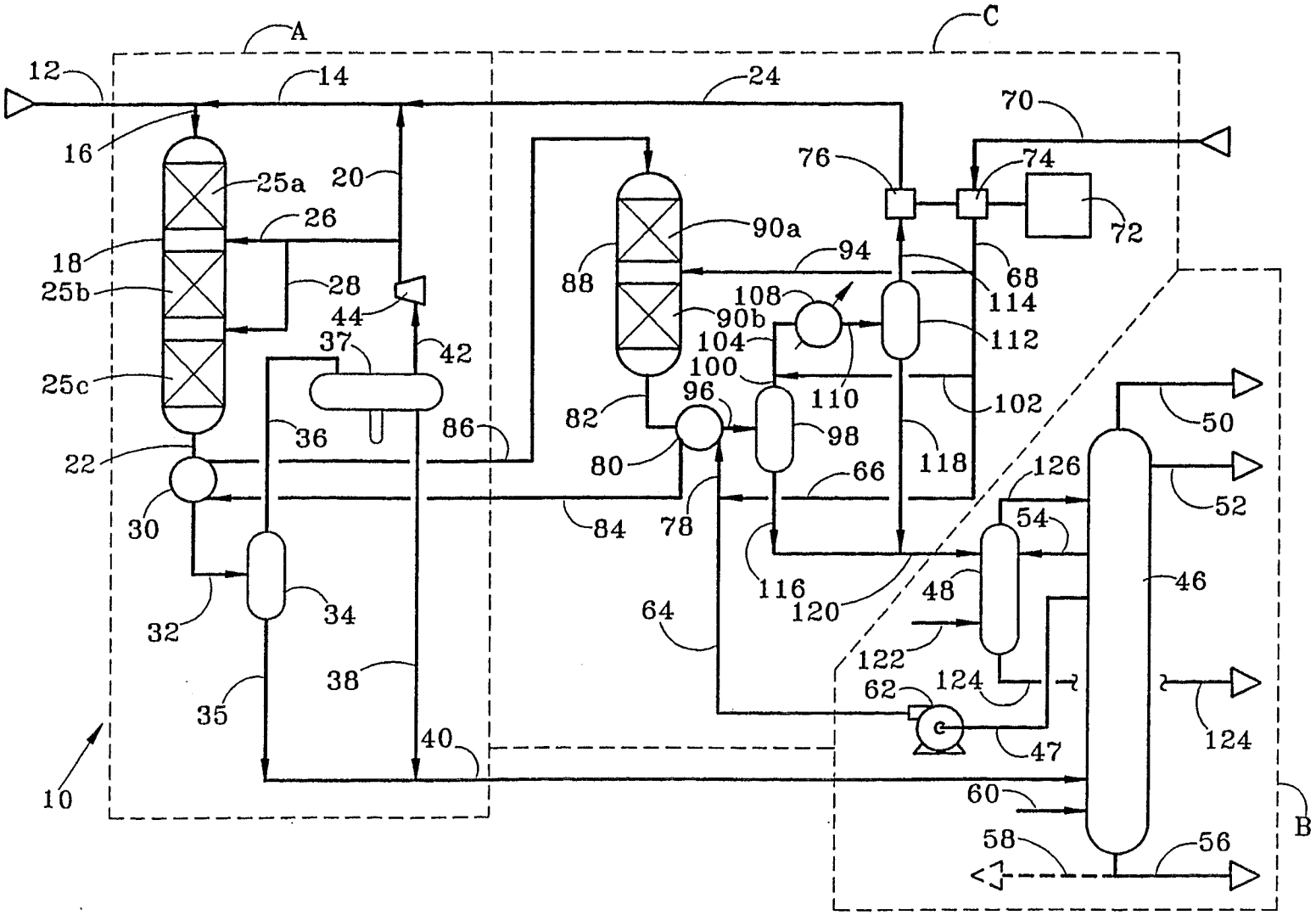
A
B
C
10
12
14
16
18
20
22
24
25a
25b
25c
26
28
30
32
34
35
36
37
38
40
42
44
46
47
48
50
52
54
56
58
60
62
64
66
68
70
72
74
76
78
80
82
84
86
88
90a
90b
94
96
98
100
102
104
108
110
112
114
116
118
120
122
124
126

INTEGRATED PROCESS FOR UPGRADING MIDDLE DISTILLATE PRODUCTION

FIELD OF THE INVENTION

The present invention relates to a process for upgrading middle distillate production from a heavy hydrocarbon feed by integrating a hydrotreating unit into a single-step hydrocracking process.

BACKGROUND OF THE INVENTION

Hydrocracking heavy petroleum-based hydrocarbon feedstocks into lower molecular weight products such as liquid petroleum gas, gasoline, jet fuel and diesel oil is well known in the art. In recent years, the processing of vacuum gas oils (VGO) into high-quality middle distillates has become increasingly important as crude quality has fallen and the demand for cleaner burning diesel and jet fuel has increased.

To enhance the quality of a refinery product slate (as well as product selectivity and flexibility to meet new market demands), it is a common practice to hydrocrack a feedstock, such as VGO, at either a relatively low or high pressure and then introduce the hydrocracked effluent as a partially converted, high quality feedstock to a stand-alone processing step downstream. Among potential downstream processing steps, there can be mentioned aromatics saturation, desulfurization and denitrogenation, catalytic dewaxing, thermal cracking, and the like. In such a manner, VGO feedstocks have been selectively refined into gasoline, middle distillate and/or lube oil products having improved properties for sulfur, nitrogen and aromatics content, low temperature viscosity, burn temperature, etc.

Hibbs et al., "Alternative Hydrocracking Applications," published by UOP of Des Plaines, Ill. (1990), describes several processes wherein VGO feedstocks are initially hydrocracked under mild or high pressure conditions to produce a high quality, partially converted feedstock. Such feedstocks are used in a downstream thermal cracking unit for maximizing diesel output, an FCC unit for maximizing gasoline output, a catalytic dewaxing unit for enhancing a lube basestock and a steam cracker for producing ethylene.

Donnelly et al., *Oil & Gas Journal,* Oct. 27, 1980, pp. 77–82 describes a catalytic dewax process wherein wax molecules of a waxy gas oil are selectively cracked and the dewaxer effluent is fed to a stripper. A downstream hydrodesulfurization reactor can be placed either prior to or after the stripper.

Gembicki et al., *Oil & Gas Journal,* Feb. 21, 1983, pp. 116–128 describes a VGO conversion process wherein a hydrodesulfurizer or FCC feed hydrotreater is retrofitted as a mild hydrocracker (MHC) to increase middle distillate production.

S. L. Lee et al., "Aromatics Reduction and Cetane Improvement of Diesel Fuels," published by Akzo Chemicals NV, describes single-and two-stage processes for aromatics reduction and cetane improvement of diesel fuels. The single stage process consists of severe hydrotreatment of heavy diesel type feeds using a high activity NiMo catalyst. The dual stage process combines deep hydrotreatment pretreating of a light diesel-type feed to effect hydrodesulfurization and hydrodenitrogenation followed by hydrogenation over a noble metal catalyst.

U.S. Pat. No. 5,114,562 to Haun et al. describes the two-stage hydrotreatment of a middle distillate feed wherein the stream is hydrodesulfurized prior to hydrogenation over a noble metal catalyst. Following hydrotreatment, the feed is directed to a product recovery fractionation means.

U.S. Pat. No. 4,973,396 to Markey describes the two stage hydrotreatment of a virgin naphtha feed. Following a low pressure hydrotreater stage, the effluent is scrubbed and stripped of $H_2S$, and the stripper bottoms are fractionated into overhead and bottoms streams. The overhead stream is then hydrocracked using a noble metal catalyst, and the bottoms stream is fed to a product fractionator.

U.S. Pat. No. 4,990,242 to Louie et al. describes a process for producing low sulfur fuels wherein a virgin naphtha stream is fed to a first stage fractionator to produce overhead and bottoms streams. Both streams are then fed to parallel hydrotreatment units made up of a hydrotreater, an $H_2S$ scrubber and a steam stripper. Effluents from the parallel strippers can be recombined for feed to a second stage fractionator.

U.S. Pat. No. 2,853,439 to Ernst, Jr. describes a combination distillation and hydrocarbon conversion process wherein a gas oil-type feed removed from a first fractionator is fed to a catalytic cracking reactor. A major portion of the cracked effluent is returned to a lower end of the first fractionator as a stripping stream. A minor portion of the cracked effluent is fed to a second fractionator. Overheads from the second fractionator are fed to an upper end of the first fractionator.

U.S. Pat. No. 3,671,419 to Ireland et al. describes a crude oil upgrading process wherein a VGO-type feed is hydrogenated, and the hydrogenator effluent is fractionated into overhead and bottoms streams. The fractionator overhead stream is fed to a hydrocracker and the fractionator bottoms stream is fed to a catalytic cracker. The cracked effluents are then fractionated into product streams.

As far as Applicants are aware, there is no previously known conversion process for producing upgraded middle distillate wherein the hydrocarbon feed is hydrocracked at moderate conditions, the hydrocracked effluent is cooled and fed to a product fractionator, a fractionator middle distillate sidedraw is first heated by heat exchange against the hydrocracker effluent stream and then introduced to a hydrotreater reactor, and the hydrotreater effluent is fed to a distillate side-stripper.

SUMMARY OF THE INVENTION

The integration of a hydrotreatment stage such as catalytic dewaxing or aromatics saturation into a single-stage hydrocracking process upgrades the production of middle distillate fuels at reduced cost relative to stand-alone hydrocracking designs of the prior art. The present integrated process permits production of desired quality middle distillate products at a lower hydrocracker pressure since a portion of the hydrocarbon conversion can be shifted to the hydrotreatment stage. Additional advantages include a design which permits implementation of heat integration techniques and the sharing of existing process compression and steam stripping duties to minimize capital expenditure requirements. Thus, the present process is well-suited for retrofitting single-stage hydrocrackers.

In one embodiment, the present invention provides a process for hydrotreating a petroleum feedstock. A petroleum feedstock such as VGO is catalytically hydrocracked in step (a) in the presence of hydrogen at a relatively high pressure. As step (b), effluent from the hydrocracking step (a) is cooled and separated into vapor and liquid streams. The vapor stream from step (b) is recycled in step (c) to the hydrocracking step (a). As step (d), the liquid stream from step (b) is distilled in a fractionation column into one or more petroleum distillate streams including at least one middle distillate stream. A middle distillate stream from step (d) is catalytically hydrotreated in step (e) in the presence of hydrogen. Effluent from the hydrotreatment step (e) is separated in step (f) into a vapor stream containing hydrogen and a liquid stream essentially free of hydrogen. As step (g), the hydrogen-containing stream from step (f) is recycled to the hydrocracking step (a). Light components from the liquid stream from step (f) are stripped in step (h) to form an upgraded middle distillate product stream.

In a preferred embodiment, the present process includes the following additional steps: (i) compressing make-up hydrogen in a first stage of a multistage compressor; (j) supplying compressed hydrogen from step (i) to the treatment step (e); and (k) compressing the hydrogen-containing stream from step (f) in a second stage of the multistage compressor for the recycling step (g). The separation step (f) preferably comprises: (1) a primary cooling step for partially condensing liquid from the effluent from the hydrotreatment step (e); (2) a primary separating step for separating condensate firmed from the primary cooling step (1); (3) a secondary cooling step for condensing additional liquid in remaining vapor from the primary separation step (2); and (4) a secondary separating step for separating condensate formed from the secondary cooling step (3) to form the hydrogen-containing stream for the second-stage compression step (k). The hydrogen-supplying step (j) preferably comprises supplying a first portion of the compressed hydrogen from step (i) to the hydrotreatment step (e), and the process further comprises as step (l) discharging a second portion of the compressed hydrogen from step (i) into the effluent from the hydrotreatment step (e) for cooling of the resulting mixture in at least the secondary cooling step (f)(3).

The hydrotreatment step (e) can comprise dewaxing, aromatics saturation, or a combination thereof. The hydrotreatment step (e) is preferably effected at a pressure from 1 to 10 MPa. The distillation step (d) is preferably effected at a pressure up to 2 MPa. The stripping step (h) preferably comprises operating a steam side-stripper on the fractionation column, wherein feeds to the side-stripper include the liquid stream from step (f) and a second middle distillate stream from the fractionation column, and overhead vapor from the side-stripper is returned to the fractionation column. The middle distillate stream from the fractionation step (d) is preferably heated for feed to the hydrotreatment step (e), by heat exchange in series against the effluents from the hydrotreatment step (e) and the hydrocracking step (a).

As an additional embodiment, the present invention provides a hydroconversion unit. A hydrocracker is provided for catalytically processing a petroleum feedstock in the presence of hydrogen at a relatively high pressure and temperature. Means are provided for cooling effluent from the hydrocracker. One or more hydrocracker effluent separators are provided for separating the cooled hydrocracker effluent into vapor and liquid streams. A recycle compressor is provided for compressing the vapor stream from the separator for recycle to the hydrocracker. A fractionation column is provided for distilling the liquid stream from the separator into a plurality of petroleum distillate streams including at least one middle distillate stream. A catalytic reactor is provided for treating a middle distillate stream from the fractionation column in the presence of hydrogen. At least one heat exchanger is provided for cooling the catalytic reactor effluent. At least one reactor effluent separator is provided for separating the cooled reactor effluent into vapor and liquid streams. A stripper is provided for stripping light components from the liquid stream from the reactor effluent separator to form an upgraded middle distillate product. A make-up hydrogen compressor is provided for supplying compressed hydrogen to the catalytic reactor and the hydrocracker.

The make-up hydrogen compressor is preferably a two-stage compressor. The first stage is adapted to discharge a first portion of hydrogen to the catalytic reactor, and a second portion to the catalytic reactor effluent for cooling in at least one of the reactor effluent coolers. The second stage is adapted to compress the vapor stream from the reactor effluent separator and to discharge to the hydrocracker.

In a preferred arrangement, the unit comprises primary and secondary heat exchangers for cooling the catalytic reactor effluent and primary and secondary catalytic reactor effluent separators. The primary separator is adapted to separate condensate from the effluent cooled in the primary heat exchanger. The secondary heat exchanger is adapted to cool vapor from the primary separator. The secondary separator is adapted to separate condensate from the cooled effluent from the secondary heat exchanger to form a vapor feed stream to the second compressor stage. A first line is preferably provided for discharging a first portion of compressed hydrogen from the first stage of the make-up compressor to the catalytic reactor. A second line preferably discharges a second portion of compressed hydrogen from the first stage of the make-up compressor into the catalytic reactor effluent for cooling in at least the second heat exchanger.

The catalytic reactor can operate as a dewaxing reactor, an aromatics saturation reactor, or a combination thereof. The catalytic reactor preferably operates at a pressure from 1 to 10 MPa. The fractionator column preferably operates at a pressure up to 2 MPa. The stripper is preferably a side unit on the fractionation column adapted for receiving liquid feeds selected from middle distillate streams from the fractionation column and the reactor effluent separator, and including a line for returning vapor from the side stripper to the fractionation column. A line is preferably provided for passing the middle distillate stream from the fractionation column, through the heat exchanger for cooling the catalytic reactor effluent and through a heat exchanger for cooling the hydrocracker effluent, to heat the middle distillate stream for feed to the catalytic reactor.

BRIEF DESCRIPTION OF THE DRAWING

The FIGURE shows a schematic flow diagram of the integrated middle distillate upgrade process of the present invention.

DETAILED DESCRIPTION OF THE INVENTION

Middle distillate produced as a product of a single-stage hydrocracker process is upgraded by processing in an integrated hydrotreatment stage of the present invention. The middle distillate stream to be upgraded is withdrawn from a fractionator tower and directed to the hydrotreatment stage. The effluent from the hydrotreatment stage is condensed and the recovered liquid is stripped of lighter components in a fractionator side-stripper to produce an upgraded product. Advantages of the present integrated process over the stand-alone prior art include a reduction in the hydrocracker operating pressure and the use of heat integration techniques to eliminate the need for a fired hydrotreater feed preheater. In addition, duties of the hydrocracker recycle and hydrogen makeup compressors, and the fractionator middle distillate side-stripper can be shared to eliminate the need for such equipment dedicated in the hydrotreatment stage.

Referring to the Figure, an integrated hydroconversion process 10 of the present invention for upgrading a middle distillate product comprises a hydrocracker stage A, a product fractionation stage B, and an integrated hydrotreater stage C having common equipment with the stages A, B. By the term "upgrading," it is meant improved fuel burn quality (i.e. cetane number, smoke point and sulfur/nitrogen weight percent) from a pollution reduction viewpoint. In addition to the production of an upgraded product, the present process enhances product yield and improves the rate of hydrogen consumption in comparison to the prior art.

A suitable heavy hydrocarbon feed 12 is combined with a hydrogen-rich stream 14 and introduced through line 16 to a reactor 18 of the hydrocracker stage A. An exemplary hydrocarbon feed stream 12 is a vacuum gas oil (VGO) having a boiling point range of about 180° C.–600° C. (360°–1100° F.) produced by the vacuum distillation of crude petroleum and/or by coking of a very heavy, residuum hydrocarbon feed stream from a vacuum tower. The hydrogen-rich feed stream 14 typically comprises a hydrogen-rich recycle stream 20 recovered from a hydrocracker reactor effluent stream 22 and a hydrogen-rich recycle stream 24 recovered from the hydrotreating stage C.

Operation and design of the hydrocracker 18 are well known in the art. The hydrocracker 18 as illustrated can comprise serially staged fixed catalyst beds 25*a*, 25*b*, 25*c*. It is understood that the number of stages employed will depend on various design criteria including catalyst efficiency and design reactor space velocity, etc. Each catalyst stage preferably has a separate hydrogen feed to ensure an adequate hydrogen partial pressure in the succeeding bed(s). Sidestreams of the hydrocracker hydrogen-rich recycle stream 20 are preferably introduced through lines 26, 28 to the catalyst beds 25*b*, 25*c*.

Depending on the degree of severity required, the hydrocracker 18 will operate at a temperature of from 350° C. to 450° C. and a pressure of from about 5 to about 21 MPa. Due to the use of downstream hydrotreating of the middle distillate product, the present hydrocracker 18 can be operated under mild to moderate severity corresponding to a pressure of from about 5 to about 12 MPa. A suitable fixed-bed-type catalyst can be used with or without regeneration.

The effluent stream 22 removed from the hydrocracker 18 is cooled by an exchange of heat against a cooling medium circulating in a cross-exchanger 30 to condense condensable components therefrom. A mixed vapor-liquid effluent stream 32 is directed to a hot high pressure separator (HHPS) 34 at a temperature from about 200° to about 300° C. to effect a vapor-liquid phase separation. The liquid phase is removed through line 35 and the vapor phase removed through line 36 is further cooled in a conventional manner by cross-exchange against another process stream, by air cooling or the like (not shown), and directed to a cold high pressure separator (CHPS) 37 at a temperature of from about 30° to about 60° C. In the CHPS 37, the separated liquid phase is withdrawn through line 38 and optionally combined with the liquid stream 35 from the HHPS 34. A combined liquid stream 40 then comprises a feed stream for the fractionation stage B. A vapor stream 42 taken from the CHPS 37 is boosted in pressure by a recycle compressor 44 and discharged as the hydrocracker hydrogen-rich recycle stream 20 mentioned above.

The liquid stream 40 is introduced to a fractionator tower 46 of the fractionator stage B at a relatively low section thereof. In the fractionator tower 46, at least one middle distillate fraction having a suitable bubble point range is removed from an intermediate tray through line 47 for feed to the hydrotreating section C. The middle distillate fraction in line 47 will generally have a bubble point temperature range of from about 177° C. to about 357° C. and a 15° C. density of about 30°–45° API.

Typically, other appropriate hydrocarbon distillate fractions are produced as well. Such fractions can be withdrawn as a fuel product having the desired specifications or as feed to a product finishing side-column 48 as required. Generally, the distillate fractions will include: a liquid petroleum gas product (LPG) removed overhead through line 50; a naphtha product removed from an upper tray of the fractionator 46 through line 52; a second middle distillate product removed from a relatively upper section of the fractionator 46 through line 54; and a low sulfur gas oil bottoms product withdrawn via line 56. A portion of the bottoms product can be, if desired, recycled through line 58 to the hydrocracker reactor 18.

Overall, operation and design of the fractionator tower 46 and associated finishing columns (of which only the side-stripper 48 is shown) are well known in the art. Such a tower 46 will generally contain about 30–50 vapor-liquid equilibrium trays and operate at an overhead temperature and pressure on the order of 40°–60° C. and 0.05–0.2 MPa (10–30 psig), and a bottoms temperature and pressure of approximately 300°–400° C. and 0.1–0.25 MPa (20–40 psig). Steam is preferably injected at the tower bottom section through line 60 to facilitate stripping of volatile components.

The present process is well suited for implementing heat integration energy savings techniques. Reaction heat generated by the hydroconversion reactions in the hydrocracking stage A and the hydrotreating stage C can be recovered for heating the middle distillate feed to the hydrotreating stage C. Thus, the middle distillate in line 47 is preferably supplied via pump 62 through line 64 as a heat exchange medium for heat exchange against effluent streams of the hydrocracking and hydrotreating stages A, C.

A compressed hydrogen makeup stream 66 is preferably introduced into line 64 upstream from any heating equipment. The compressed hydrogen stream 66 comprises a first portion of a hydrogen makeup stream introduced through line 70. The hydrogen makeup stream 70 is compressed to the operating pressure of the hydrotreater stage C by a hydrogen makeup compressor 72 having first and second stages 74, 76. A suitable portion of the first stage discharge is then directed via line 66 into line 64. A hydrogen-containing middle distillate stream 78 thus produced is preferably initially circulated as a heat exchange medium through a cross-exchanger 80 against an effluent stream 82 from the hydrotreating stage C. In the cross-exchanger 80, the middle distillate stream 78 is partially preheated and the effluent stream 82 is partially cooled. A heated middle distillate stream 84 is then circulated as a cooling medium to the cross-exchanger 30. In the cross-exchanger 30, the hydrocracker effluent stream 32 is cooled and middle distillate feed stream 86 is heated for feed to a hydrotreater reactor 88 at an upper end thereof.

Operation and design of the hydrotreater 88 is well known in the art and similar to that of the hydrocracker 18. The hydrotreater 88 as illustrated comprises a pair of serially staged fixed catalyst beds 90*a*, 90*b*. The number of stages employed will depend on various design criteria including catalyst efficiency and design reactor space velocity, etc. Each catalyst stage preferably has a separate hydrogen feed to ensure an adequate hydrogen partial pressure in the succeeding bed(s). For example, a second portion of the compressed makeup hydrogen from line 68 can be introduced to the second hydrotreater stage 90*b* through line 94.

The reaction effluent stream 82 of the hydrotreater 88 is cooled in exchanger 80 as mentioned above to condense condensable components therefrom. A mixed phase stream from the cross-exchanger 80 is introduced via line 96 to a first stage vapor-liquid separation vessel 98. The vapor phase therefrom is withdrawn through line 100 and preferably mixed with a third portion of the compressed makeup hydrogen 68 supplied via line 102. A combined vapor stream 104 is further cooled to condense condensables therefrom by heat exchange in a cooler 108 employing a suitable heat transfer medium such as boiler feed water, for example. Thus formed, a mixed-phase stream 110 is directed to a second stage vapor-liquid separator 112. Hydrogen-containing vapor 114 withdrawn from the separator 112 is compressed to the operating pressure of the hydrocracking stage A at the hydrogen makeup compressor 72 second stage 76. A compressed hydrogen makeup stream is then recycled to the hydrocracker 18 via lines 24, 14 and 16 as mentioned previously.

Liquid phases separated in the first and second stage separators 98, 112 are recovered via respective lines 116, 118 as an upgraded middle distillate product. The upgraded product stream, however, is first preferably stripped using steam to separate any remaining undesirable light end components. In the practice of the present process, a dedicated stripper column commonly used with a stand-alone hydrotreating process of the prior art is not necessary,. Instead, the stripping column for the hydrotreating stage C can be integrated with the side stripping column 48 in the fractionation stage B. Therefore, the liquid streams 116, 118 are preferably combined in line 120 for feed to the fractionator side-stripper 48. The side-stripper 48 has a steam feed line 122 for supplying stripping steam. An upgraded middle distillate product is preferably removed as side-stripper bottoms stream through line 124. Light end components with steam taken overhead are recycled to the fractionator 46 through line 126.

The upgraded middle distillate stream 124 will generally contain less than 50 ppmw sulfur, less than 10 ppmw nitrogen, 25 percent by weight or less of mono-aromatics, 1 percent by weight or less di- or tri-aromatics and have a cetane index of 49 or greater. Preferably, the upgraded middle distillate product 124 will contain less than 5 ppmw each of sulfur and nitrogen, 15 percent by weight or less of mono-aromatics, 0.5 weight percent or less di- or tri-aromatics, and have a cetane index of 55 or greater.

Examples of suitable hydrotreating reactions which can be employed for upgrading middle distillate in a hydrotreater reactor 88 include an aromatics saturation (hydrogenation) reaction, a catalytic dewax reaction, hydroprocessing reaction (mild or severe), demetalization, hydrodenitrogenation, hydrodesulfurization, a combination thereof, and the like. Such reactions are typically conducted at elevated temperature and pressure in the presence of hydrogen over a selective fixed-bed catalyst.

For conducting a preferred aromatics saturation reaction, the reactor temperature can range from 250° to 350° C., the operating pressure can be from about 3 to about 7 MPa and a CoMo or NiMo base metal or a noble metal catalyst can be employed.

For conducting a preferred catalytic dewax reaction, the reactor operating temperature can typically range from 260° C. to 425° C., the operating pressure can be from 2.7 to 5.5 MPa, and the hydrogen circulation rate is from about 100 to 300 normal cubic meters hydrogen per cubic meter hydrocarbon. The dewax catalyst is known to have unique shape-selective properties that allow only normal and slightly branched paraffins to enter its pores. These molecules are cracked at active sites inside the catalyst structure to produce gasoline boiling range paraffins and olefins. The remaining molecules in the distillate charge pass through the catalyst pores essentially unchanged.

The present hydrocarbon refining process and apparatus are illustrated by way of the foregoing description. The foregoing description is intended as a non-limiting illustration, since many variations will become apparent to those skilled in the art in view thereof. It is intended that all such variations within the scope and spirit of the appended claims be embraced thereby.

I claim:

1. A process for hydrotreating a petroleum feedstock comprising the steps of:

(a) catalytically hydrocracking a petroleum feedstock in the presence of hydrogen at a pressure ranging from 5 to 21 MPa;

(b) cooling and separating effluent from the hydrocracking step (a) into vapor and liquid streams;

(c) recycling the vapor stream from step (b) to the hydrocracking step (a);

(d) distilling the liquid stream from step (b) in a fractionation column into petroleum distillate streams including first and second middle distillate streams characterized by a bubble point temperature ranging from about 177° C. to about 357° C. and an API density at 15° C. ranging from about 30° to about 45°;

(e) catalytically hydrotreating the first middle distillate stream from step (d) in the presence of hydrogen;

(f) separating effluent from the hydrotreatment step (e) into a vapor stream containing hydrogen and a liquid stream essentially free of hydrogen;

(g) recycling the hydrogen-containing vapor stream from step (f) to the hydrocracking step (a); and (h) steam stripping the liquid stream from step (f) with the second middle distillate stream from step (d), in a side stripping column integrated with the fractionation column in distilling step (d) to return overhead vapor from the side stripping column to the fractionation column, to form an upgraded middle distillate product stream.

2. The process of claim 1 further comprising the steps of:

(i) compressing make-up hydrogen in a first stage of a multistage compressor;

(j) supplying compressed hydrogen from step (i) to the hydrotreatment step (e);

(k) compressing the hydrogen-containing vapor stream from step (f) in a second stage of the multistage compressor for the recycling step (g).

3. The process of claim 2, wherein the separation step (f) comprises:

(1) a primary cooling step for partially condensing liquid from the effluent from the hydrotreatment step (e);

(2) a primary separating step for separating condensate formed from the primary cooling step (1);

(3) a secondary cooling step for condensing additional liquid in remaining vapor from the primary separation step (2); and (4) a secondary separating step for separating condensate formed from the secondary cooling step (3) to form the hydrogen-containing stream for the second-stage compression step (k).

4. The process of claim 3, wherein said step (j) supplies a first portion of the compressed hydrogen from step (i) to the hydrotreatment step (e), and further comprising a step (l) for discharging a second portion of the compressed hydrogen from step (i) into the effluent from the hydrotreatment step (e) prior to cooling of the resulting mixture in at least the secondary cooling step (f)(3).

5. The process of claim 1, wherein the hydrotreatment step (e) consists of dewaxing, aromatics saturation or a combination thereof.

6. The process of claim 1, wherein the hydrotreatment step (e) is at a pressure from 1 to 10 MPa.

7. The process of claim 1, wherein the distillation step (d) is at a pressure up to 2 MPa.

8. The process of claim 1, comprising heating the middle distillate stream from the fractionation step (d) for feed to the hydrotreatment step (e), by heat exchange in series against the effluents from the hydrotreatment step (e) and the hydrocracking step (a).

* * * * *